US009937429B2

(12) United States Patent
Pascale

(10) Patent No.: US 9,937,429 B2
(45) **Date of Patent: *Apr. 10, 2018**

(54) VARIABLE SOUND GENERATOR

(71) Applicant: SynCon InVentures, LLC, Matthews, NC (US)

(72) Inventor: Robert Pascale, Matthews, NC (US)

( * ) Notice: Subject to any disclaimer, the term of this patent is extended or adjusted under 35 U.S.C. 154(b) by 2 days.

This patent is subject to a terminal disclaimer.

(21) Appl. No.: 13/760,940

(22) Filed: Feb. 6, 2013

(65) Prior Publication Data

US 2013/0324010 A1 Dec. 5, 2013

Related U.S. Application Data

(63) Continuation-in-part of application No. 13/482,087, filed on May 29, 2012.

(51) Int. Cl.

| | |
|---|---|
| ***A63H 3/28*** | (2006.01) |
| ***A63H 5/00*** | (2006.01) |
| *A63H 33/18* | (2006.01) |
| *A63H 3/02* | (2006.01) |

(52) U.S. Cl.

CPC ..... *A63H 5/00* (2013.01); *A63H 3/02* (2013.01); *A63H 3/28* (2013.01); *A63H 33/18* (2013.01); *A63H 2200/00* (2013.01)

(58) Field of Classification Search

CPC ..... A63H 5/00; A63H 5/28; A63H 3/28
USPC ..... 446/270, 297, 397, 404, 81; 119/707
See application file for complete search history.

(56) References Cited

U.S. PATENT DOCUMENTS

| | | | | |
|---|---|---|---|---|
| 4,432,159 | A * | 2/1984 | Kanno | 446/410 |
| 4,662,260 | A * | 5/1987 | Rumsey | 84/653 |
| 5,471,192 | A * | 11/1995 | Dash | 340/384.3 |
| 5,674,076 | A * | 10/1997 | Billings et al. | 434/365 |
| 6,098,571 | A * | 8/2000 | Axelrod et al. | 119/707 |
| 6,150,947 | A * | 11/2000 | Shima | 340/692 |
| 6,200,186 | B1 * | 3/2001 | Coleman et al. | 446/73 |
| 6,215,978 | B1 * | 4/2001 | Ruzic et al. | 434/311 |
| 6,371,053 | B1 * | 4/2002 | Tsengas | 119/707 |
| 6,431,937 | B1 * | 8/2002 | Lau et al. | 446/175 |
| 6,481,381 | B2 * | 11/2002 | Ritchey | 119/708 |
| 6,578,527 | B1 * | 6/2003 | Mathers | 119/707 |
| 6,892,674 | B1 * | 5/2005 | Dubinins et al. | 119/707 |
| 7,074,106 | B1 * | 7/2006 | Deutsch et al. | 446/175 |
| 7,121,230 | B2 * | 10/2006 | Ritchey | 119/708 |
| 7,144,293 | B2 * | 12/2006 | Mann et al. | 446/184 |
| 8,025,550 | B2 * | 9/2011 | Tsengas et al. | 446/270 |
| 8,322,308 | B2 * | 12/2012 | Curry et al. | 119/707 |
| 8,398,451 | B2 * | 3/2013 | Wolfe et al. | 446/175 |

(Continued)

*Primary Examiner* — Melba Bumgarner
*Assistant Examiner* — Joseph B Baldori
(74) *Attorney, Agent, or Firm* — Harvey Lunenfeld

(57) ABSTRACT

The device includes an accelerometer for sensing a parameter of movement, such as direction and/or magnitude. A pre-recorded sound is played in response to the sensed movement. The speed and/or pitch at which the pre-recorded sound is played is a function of the sensed movement parameter. There may be one or more pre-recorded sounds from which playback is chosen. In one embodiment, hard-wired circuits set the characteristics of the generated sound in accordance with the accelerometer output. In a second embodiment, the software selects which pre-recorded sound to play and sets the characteristics of the sound based upon parameters sensed by the accelerometer.

1 Claim, 7 Drawing Sheets

(56) References Cited

U.S. PATENT DOCUMENTS

| | | | | |
|---|---|---|---|---|
| 2001/0049249 | A1* | 12/2001 | Tachau et al. | 446/397 |
| 2005/0005873 | A1* | 1/2005 | Gick | 119/707 |
| 2005/0287911 | A1* | 12/2005 | Schulze | 446/297 |
| 2006/0084360 | A1* | 4/2006 | Stern | 446/397 |
| 2006/0249096 | A1* | 11/2006 | Gick | 119/707 |
| 2008/0011244 | A1* | 1/2008 | Gick | 119/707 |
| 2010/0199924 | A1* | 8/2010 | del Pinal et al. | 119/707 |
| 2011/0034103 | A1* | 2/2011 | Fong et al. | 446/297 |
| 2011/0045736 | A1* | 2/2011 | Wooten | 446/397 |
| 2011/0065354 | A1* | 3/2011 | Wolfe et al. | 446/297 |
| 2011/0195632 | A1* | 8/2011 | Chow | 446/397 |
| 2011/0244973 | A1* | 10/2011 | Brown et al. | 472/118 |
| 2013/0324009 | A1* | 12/2013 | Pascale | 446/397 |
| 2013/0324010 | A1* | 12/2013 | Pascale | 446/397 |

* cited by examiner

VARIABLE SOUND GENERATOR

CROSS-REFERENCE TO RELATED APPLICATIONS

This is a continuation-in-part of application Ser. No. 13/482,087, filed May 29, 2012, and the benefit under 35 USC 120 for all common subject matter is hereby claimed.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to sound generators and more particularly to a device including a sound generator which is capable of generating sounds of different characteristics depending upon the direction and/or magnitude of movement to which the device is subjected.

2. Description of Prior Art Including Information Disclosed Under 37 CFR 1.97 and 1.98

It is known in the art to provide a pet toy in the form a plush stuffed animal with an internal sound generating device activated by external pressure applied to the toy by the jaws of the pet, as the pet chews on the toy. Toys having sound generating capability are particularly well suited for use with pets such as dogs and cats. They enhance the play value of the toy by creating a sound in response to the application of pressure by the pet.

Typically, the sound generating device located within the toy includes an air chamber having a port within which a reed or whistle is situated. As the pet applies pressure to the exterior of the toy, the air is squeezed out of the chamber through the port, causing the reed or whistle to emit a sound. For example, see for example U.S. Pat. No. 7,144,293.

However, toys having this type of squeeze activated sound emitter are limited to producing only a single sound. Accordingly, such toys enhance the attractiveness of the toy to the pet only to a limited extent.

Another approach that has been employed is to use a prerecorded sound chip. For example, U.S. Pat. No. 6,371,053 teaches an animal toy with a sound chip assembly that includes a shaker barrel activator, a prerecorded sound chip and a battery. The device is designed to emit a prerecorded sound in response to movement of sound chip assembly. The sound can be a prerecorded sound such as an animal's voice (meow, prrr), a beeping sound, a human voice, other voices, user recorded voices, etc., and can last for any desired period. U.S. Pat. No. 8,025,550 discloses a similar toy, but the device also includes a cage and LED lights.

U.S. Patent Publication No. 2010/0199924 relates to a pet toy having a sound module that includes an integrated circuit, and a power source, connected to a speaker such that, upon actuation of the device through movement or otherwise, a signal is generated causing an audible sound.

U.S. Pat. Nos. 6,200,188 and 6,431,937 disclose various toys that make noises in response to movement. These patents teach devices with an electronic circuit that includes a speaker and an optical sensor or motion sensor, where the optical sensor may cause activation of the speaker driver in response to movement sensed by the optical sensor.

U.S. Pat. Nos. 6,481,381 and 7,121,230 disclose a pet-play apparatus configured for interactive use. These patents teach a cat toy that includes a toy animal, like a mouse, attached to the end of a lasso. A sonic device that includes an electronic circuit with a piezoelectric element configured to produce a prey sound when subjected to motion is employed.

U.S. Patent Publication No. 2001/0049249 discloses an interactive toy, such as a toy tank or plane, that includes memory and a processor, where the memory stores both a number of different play scenarios as well as a child's previous play pattern, and the toy includes one or more movable portions, such as a wing or landing gear, where a sensor detects the movement of the movable portion and the processor, coupled to the sensor and the memory, responds to a movement of the movable portion, the stored play pattern, and a play scenario by causing a sound to be synthesized in real-time.

U.S. Patent Publication No. 2011/0244973 discloses a play system accessory with motion-activated sound module. This document teaches a support configured to be suspended from or supported on a play system with a sound module including a motion detector for detecting motion of the support and a sound-emitting device for emitting sounds in response to motion of the support.

U.S. Pat. No. 4,432,159 discloses a toy and associated noise producing mechanism. The toy has a base, and a rotating member on the base that is capable of rotating both clockwise and counterclockwise such that in response to rotation of the rotating member in a clockwise and counterclockwise direction, respectively, the rotating member contacts and engages the member and moves the member in a first and a second direction, respectively. A noise emitting mechanism is also located on the base and is operatively associated with the member. The noise emitting mechanism is capable of emitting at least two different types of noise.

However, none of the above noted references teach a pet toy with an internal sound generating circuit capable of creating different sounds depending upon the direction and magnitude of motion being sensed. More particularly, none of those references teach a battery powered device for use in a pet toy or the like including accelerometer connected to a control circuit which regulates a sound chip to cause the device to emit a sound the characteristics of which are a function of the direction and magnitude of the motion sensed by the accelerometer.

It is, therefore, a prime object of the present invention to provide a variable sound generator suitable for use in a toy, including a pet toy.

It is another object of the present invention to provide a variable sound generator which includes an accelerometer capable of sensing movement in more than one direction.

It is another object of the present invention to provide a variable sound generator including a control circuit which regulates the characteristics of the sound emitted in accordance with the direction and magnitude of movement sensed by the accelerometer.

It is another object of the present invention to provide a variable sound generator which including a control circuit which regulates the speed at which a pre-recorded sound is emitted in accordance with the direction and magnitude of movement sensed by the accelerometer.

It is another object of the present invention to provide a variable sound generator which includes the capability to emit different pre-recorded sounds whose speed can be regulated in accordance with the direction and magnitude of movement sensed by the accelerometer. It is another object of the present invention to provide a variable sound generator which includes a control circuit which sets the speed at which a sound chip operates to vary the generated sound.

It is another object of the present invention to provide a variable sound generator which includes an optional amplifier circuit for regulating the volume of the sound emitted.

It is another object of the present invention to provide a variable sound generator which includes a generally spherical housing into which the sound generating circuitry is situated.

BRIEF SUMMARY OF THE INVENTION

The above objects are achieved by the present invention which relates to a device for producing sound. The device includes means for sensing movement in more than one direction, means for generating sound in response to the sensed movement and means for controlling the characteristics of the sound generated in response to the sensed movement as a function of the direction of the sensed movement.

The movement sensing means senses the magnitude of movement. The sound generating means generates sound in response to movement of a magnitude exceeding a pre-set level.

The movement sensing means senses movement in at least two directions. Preferably, the movement sensing means senses movement in three directions.

The sound generating means includes an oscillator which determines the speed at which a pre-recorded sound is processed. The control means provides a control signal which sets the oscillator to cause the sound generating means to generate a sound signal at a speed which is a function of the number of directions of sensed movement.

More specifically, the oscillator control signal causes the sound generating means to generate a sound at a first speed in response to movement in one direction. The oscillator control signal causes the sound generating means to generate a sound of at a second speed in response to movement in two directions. The oscillator control signal causes the sound generating means to generate a sound of at a third speed in response to movement in three directions.

The control means includes series connected resistors and means for bypassing selected ones of the resistors, depending upon the number of directions in which movement is sensed.

The control means includes series connected resistors, at least one of which resistors is connected in parallel with a bypass transistor, wherein the bypass transistor is not actuated when movement in one direction is sensed.

The control means includes series connected resistors, at least two of which resistors are connected in parallel with bypass transistors, wherein a selected one of the bypass transistors is actuated when movement in two directions is sensed.

The control means includes series connected resistors, at least two of which resistors are connected in parallel with bypass transistors, wherein both of the bypass transistors are actuated when movement in three directions is sensed.

The device also includes a housing for enclosing the circuitry. In one embodiment of the invention, the housing is received within a pet toy, such as a plush stuffed animal.

In accordance with another aspect of the present invention, a sound generating device is provided including an accelerometer generating an output signal which is a function of the direction of sensed movement, a sound signal generating circuit, a speaker connected to the sound generating circuit for generating a sound when energized and a control circuit operably connected to control the sound signal generating circuit in accordance with the output signal of the accelerometer.

Preferably, the accelerometer is capable of sensing the direction and the magnitude of movement.

The control circuit causes the sound generating circuit to generate a sound signal to the speaker when the accelerometer senses movement of magnitude exceeding a pre-set level.

The control circuit causes the sound generating circuit to generate a sound signal to the speaker to emit a sound the characteristics of which are dependent upon the number of directions of movement sensed by the accelerometer.

The device further includes a housing into which the accelerometer, the sound generating circuit, and the control circuit are situated. The housing is designed to be received within a toy. The toy is a preferably a pet toy in the form of a plush stuffed animal.

In accordance with another aspect of the present invention, a method for creating a sound is provided. The method includes: sensing movement in more than one direction; generating a sound in response to sensing movement and direction; and controlling the characteristics of the generated sound in accordance with the direction of sensed movement.

The step of sensing movement includes the steps of: sensing the magnitude of movement; and generating the sound when particular criteria are met. The step of sensing movement includes the step of sensing the direction of movement.

The criteria for generating a sound with particular characteristics are defined as a pre-configured combination of direction and/or magnitude. The step of controlling the characteristics of the generated sound includes the step of generating a sound with a different characteristic if movement is sensed that exceeds pre-determined magnitudes and/or directions. The method includes the step of controlling the speed of the generated sound by varying the setting of an oscillator in the sound generating circuit in accordance with the number of directions of sensed movement.

The method further includes the steps of creating a housing within which the movement sensing, sound generating and characteristics controlling steps are performed.

The method also includes the step of creating a toy within which the housing is received.

In accordance with another aspect of the present invention a device is provided for producing sound. The device includes means for sensing a parameter such as direction or magnitude, associated with the movement of the device. Means are provided for generating sound in response to the sensed movement. Means are provided for controlling the characteristics of the sound generated in response to the sensed movement. The controlling means includes a programmable microcontroller capable of storing and implementing a series of software commands for determining the speed and pitch of a pre-recorded sound generated by the sound generating means based upon the sensed parameter.

The microcontroller includes means for actuating the sound generating means to generate sound in two manners: 1) using a single recorded sound at one of several sound levels, which may be one or more, with each sound level having a different speed and/or pitch; 2) using multiple pre-recorded sounds, at one of several sound levels, which may be one or more, with each sound level having a different speed and/or pitch. The microcontroller includes means for causing the sound generating means to select and generate sound at a sound level when the sensed parameter exceeds a pre-configured threshold or the sensed parameter indicates that the device is in free fall.

The microcontroller includes means for determining if the sound generating means is actuated to generate sound at the selected one of the sound levels.

The microcontroller includes means for actuating the sound generating means to generate sound at the selected one of the sound levels.

The microcontroller includes means for actuating the sound generating means to continue to generate sound at the selected one of the sound levels.

The microcontroller includes means for actuating the sound generating means to continue to generate sound at the selected one of the sound levels.

The microcontroller includes means for deactuating the sound generating means if the sensing means senses that the sensed parameter no longer exceeds any playback threshold for a pre-determined time period after the sound generating means has finished playing the recorded sound.

The microcontroller includes means for entering the "rest" mode if the sensing means senses that the sensed parameter no longer exceeds any playback threshold for a pre-determined time period after the sound generating means has finished playing the recorded sound.

The microcontroller includes means for entering the "rest" mode if the sensed parameter does not exceed the first threshold for a pre-determined time period after the sound generating means has finished playing the recorded sound.

The sensed parameter may be force magnitude and/or direction.

The microcontroller includes means for determining the number of thresholds exceeded by the sensed parameter and for actuating the sound generating means to generate sound at a selected one of multiple sound levels, depending upon the number of thresholds exceeded by the sensed parameter.

The microcontroller includes means for causing the sound generating means to select and generate sound at a zero sound level when the sensed parameter does not exceed any threshold.

The microcontroller includes means for causing the sound generating means to select and generate sound at a pre-configured sound level when the sensing means senses that the device is in free fall.

The microcontroller includes means for causing the sound generating means to select and a generate sound at a sound level which is a function of the number of thresholds exceeded by the sensed parameter.

The microcontroller includes a plurality of parameter counters, at least one of the parameter counters is associated with each of the number of thresholds exceeded by the sensed parameter, wherein a different one of the parameter counters is enabled for each of the thresholds exceeded by the sensed parameter.

The microcontroller includes means for causing the sound generating means to select and generate sound at a pre-configured sound level when said microcontroller determines that the sensed parameter indicates that the device is in free fall.

The microcontroller includes a free fall counter and means for enabling the free fall counter when the sensing means senses that the device is in free fall.

The microprocessor includes means for determining whether the sound generating means is generating sound once one of the parameter counters or the free fall counter is enabled.

The device further includes a power down counter and means for enabling the power down counter, and after a pre-set time interval, causing the microcontroller to go into the power down mode when the sound generating means is generating sound, but no thresholds have been exceeded.

The device further includes software interrupt counters and means for enabling the power down counters, when the sound generating means is generating sound, and at least one of the parameter counters and the free fall counters is enabled, the software interrupt timers being enabled using the corresponding sound level, wherein the at least one of the parameter counters and the free fall counters are set to a pre-determined number of cycles.

The microcontroller includes means for entering the power down mode after a pre-set time period, if the sound generating means is not generating sound.

The microcontroller includes means for exiting the power down mode upon one of the parameter counters and the free fall counter being enabled.

The microcontroller includes a data buffer, and wherein the microcontroller includes means for determining if the sound generating means should generate sound and has sufficient data in the buffer to do so, and the software interrupt timers are timed out.

The microcontroller comprises means for decoding enough additional data to prevent a buffer under-run, if the sound generating means does not have enough data in the buffer to generate sound.

In accordance with another aspect of the present invention, a method is provided for generating sound in a device. The device includes means for sensing a parameter associated with the movement of the device, means for generating sound in response to the sensed movement, and means for controlling the characteristics of the sound generated in response to the sensed movement. The controlling means includes a programmable microcontroller capable of storing and implementing a series of software commands for determining the speed and pitch of a pre-recorded sound generated by the sound generating means based upon the sensed parameter.

The method includes: actuating the sound generating means to generate sound at a selected one of either one or several sound levels, wherein each of the sound levels having a different speed and/or pitch. The sound generating means is caused to select and generate sound at a sound level when the sensed parameter exceeds a pre-determined threshold or the sensed parameter indicates that the device is in free fall. The device determines if the sound generating means is actuated to generate sound at the selected one of the sound levels. If not, the sound generating means is actuated.

The sound generating means continues to generate sound at the selected one of the sound levels, if the sound generating means is already actuated, unless the sensing means senses a change in the sensed parameter.

The sound generating means is deactuated if the sensing means senses that the sensed parameter no longer exceeds any playback threshold for a pre-determined time period after the sound generating means has finished playing the recorded sound.

The microcontroller goes into "rest" mode if the sensing means senses that the sensed parameter no longer exceeds any playback threshold for a pre-determined time period after the sound generating means has finished playing the recorded sound.

The sensed parameter is force magnitude and/or direction.

The combination of magnitude and/or direction of the force relayed by the sensed parameter is determined. The sound generating means is actuated to generate sound at a selected one of multiple sound levels, depending upon the particular combination of thresholds exceeded by the sensed parameter.

Each one of the selected sound levels has a different speed and/or pitch.

Multiple sounds can be pre-recorded so that they can be selected based on pre-configured criteria and the sound levels may be applied to said sounds.

Sound levels may be applied to any, all, or none of the pre-recorded sounds.

The sound generating means is caused to select and generate sound at a zero sound level when the sensed parameter does not exceed any threshold.

The sound generating means is caused to select and generate sound at a particular sound level when the sensing means senses that the device is in free fall.

The sound generating means is caused to select and a generate sound at a particular sound level which is a function of the combination of thresholds exceeded by the sensed parameter.

The microcontroller includes a plurality of parameter counters, at least one of the parameter counters being associated with each of the combination of thresholds exceeded by the sensed parameter. A different one of the parameters counters is enabled for each of the thresholds exceeded by the sensed parameter.

The sound generating means is caused to select and generate sound at a particlar sound level when the microcontroller determines that the sensed parameter indicates that the device is in free fall.

The microcontroller has a free fall counter. The free fall counter is enabled when the sensing means senses that the device is in free fall.

If the sound generating means is generating sound once one of the parameter counters or the free fall counter is enabled, but no thresholds have been exceeded, a power down counter is enabled, and after a pre-set time interval, the microcontroller is caused to go into the power down mode.

The software interrupt timers are enabled and set using the corresponding sound level. At least one of the parameter counters and the free fall counter is set to a pre-determined number of cycles.

The microcontroller is caused to enter the power down mode after a pre-set time period, if the sound generating means is not generating sound.

The microcontroller is caused to exit the power down mode upon one of the parameter counters or the free fall counter being enabled.

The microcontroller includes a data buffer. It determines if the sound generating means should generate sound and has sufficient data in the data buffer to do so. If the sound generating means does not have enough data in the data buffer to generate sound, the microcontroller decodes enough additional data to prevent a buffer under-run.

When the parameter sensed is direction, the characteristics of the generated sound are controlled in accordance with the direction of sensed movement.

When the parameter sensed is the magnitude of movement, sound is generated when the magnitude of movement exceeds a pre-determined level.

BRIEF DESCRIPTION OF THE SEVERAL VIEWS OF DRAWINGS

To these and to such other objects that may hereinafter appears, the present invention relates to a variable sound generator for a pet toy as described in detail in the following specification and recited in the annexed claims, taken together with the accompanying drawings, in which like numerals refer to like parts and in which:

DETAILED DESCRIPTION OF THE INVENTION

Figure 1:
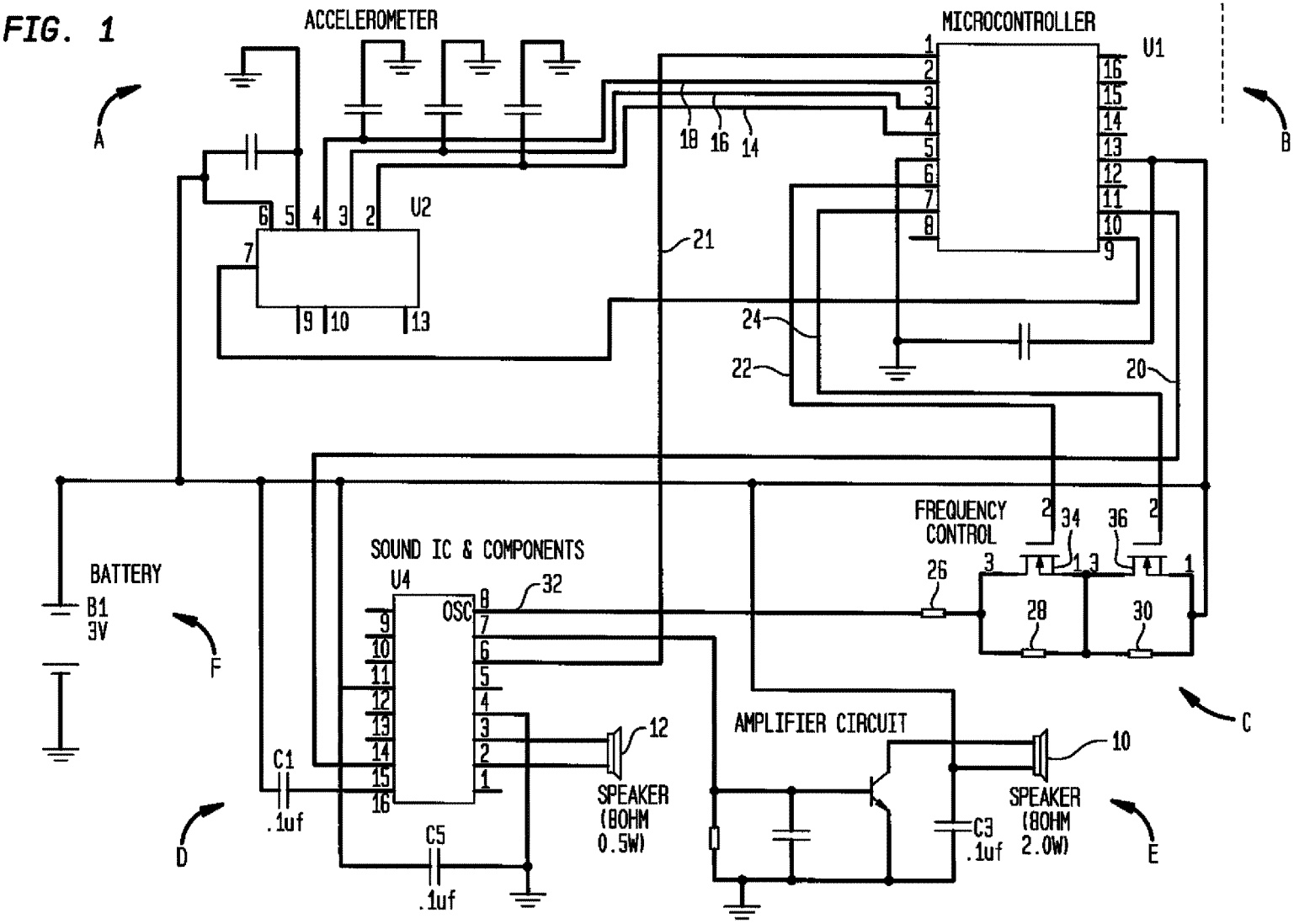
FIG. 1 is a circuit diagram of the components of a first preferred embodiment of the present invention.

As seen in FIG. 1, the device of the present invention includes an accelerometer, generally designed A, capable of providing three different output signals to a microcontroller, generally designated B. Microcontroller B is connected to a control circuit, generally designated C, which controls the speed at which a sound chip, generally designated D, processes a pre-recorded sound. Microcontroller B is also directly connected to the sound chip to activate the sound chip and monitor the output thereof. Sound chip D can either drive a speaker 10, which is part of an amplification circuit, generally designated E, or a speaker 12, connected directly to the output of the sound chip. All of the components are powered by a battery, generally designated F.

Accelerometer A is preferably a three axis board mounted accelerometer capable of generating three separate output signals, one for each of the x, y and z directions, on lines 14, 16 and 18, respectively, indicating the magnitude and direction of the motion detected by the accelerometer. One commercially available component suitable for this application is Part No. MMA7361LCT, which is a 1.5G XYZ Low G analog accelerometer supplied by Freescale Semiconductor Inc. of Austin, Tex.

The output lines 14, 16 and 18 from accelerometer A are connected to three of the inputs of microcontroller B. Microcontroller B is connected to the sound chip by lines 20 and 21 such that it can turn the sound chip on or off, and can monitor the output of the sound chip. It also provides signals to set the speed of operation of the sound chip, and hence the frequency of the sound signal generated by the sound chip, by selectively actuating transistors in control circuit C through output lines 22 and 24.

The microcontroller receives the three output signals from the accelerometer and determines if any one of the output signals has a magnitude above a pre-determined level, indicating motion detected above a threshold level in the direction associated with the line on which that output signal is present. It regulates the speed of the sound signal in accordance with the output signals from the accelerometer.

If an output signal indicating movement above the threshold level is detected on any of the output lines, an output is generated by the microcontroller on line 20 to sound chip D activating the sound chip D to generate a sound signal at a particular speed. If an output signal indicating motion above the threshold level is detected on at least two of the output lines, a high voltage output is generated by the microcontroller on line 22. If an output signal indicating motion above the threshold level is detected on all three output lines, a high voltage output is generated by the microcontroller simultaneously on both line 22 and line 24.

The microcontroller incorporates a timing circuit which includes a clock. The clock regulates the speed at which the microcontroller operates. The clock runs continuously but the timing circuit is activated once movement above the threshold level is detected in any direction and will cause the sound chip to continue to generate that sound signal for a time period determined by the length of the pre-recorded sound and for a short period thereafter, for example 2 seconds, after movement ceases, unless prior to timing out, movement in an additional direction is detected, in which case the speed of the sound chip will be reset and a pre-recorded sound will play at a different speed.

One commercially available microcontroller suitable for this application is Part No. HT46R064, which is an enhanced A/D Type 8-bit OTP MCU supplied by Holtek Semiconductor (USA), Inc. of Fremont Calif.

Control circuit C includes three series connected resistors 26, 28 and 30, which may have different resistance values. The resistors are connected between the battery F and the oscillator input 32 of sound chip D.

The control signal from the control circuit is applied to the oscillator input of the sound chip and sets the speed that the chip processes a pre-recorded sound. The speed at which the sound chip processes the pre-recorded sound determines the character of the sound that is generated. In this case, the sound chip can operate at three different speeds and hence the device can generate sounds with three different characteristics.

When the sound chip is turned on by a signal on output line 20, but no output signals are present on microcontroller output lines 22 or 24, the combined resistance of resistors 26, 28 and 30 sets the oscillator of the sound chip to cause the sound chip to generate a pre-recorded sound, which under those circumstances, will be generated at a first speed. That occurs when motion in any single direction above the threshold level is detected.

Two bypass transistors 34 and 36 are also included in the control circuit. The gate of transistor 34 is connected to output line 22 of microcontroller B. The gate of transistor 36 is connected to output line 24 of microcontroller B. The output circuit of transistor 34 is connected in parallel with resistor 28. The output circuit of transistor 36 is connected in parallel with resistor 30.

When transistor 36 is turned on, resistor 28 is bypassed, and the overall resistance of the resistor circuit is reduced, thereby changing the setting of the oscillator and causing the sound chip to generate a sound signal at a second speed. When both transistor 36 and transistor 38 are turned on, resistor 28 and resistor 30 are both bypassed, and the overall resistance of the resistor circuit is further reduced, thereby changing the setting of the oscillator and causing a sound chip to generate a sound signal at a third speed.

The sound signal from sound chip D can be applied directly to drive a speaker 12. Alternatively, the sound signal can be connected to the input of an amplifier circuit E which includes speaker 10. The advantage of using the amplifier circuit E is that the sound generated by the sound chip may be louder and the amplitude of the sound signal may be either pre-set or varied as appropriate.

The sound chip also has an output line 21 which is connected to an input of microcontroller B. A signal from the sound chip on output line 21 indicates that the sound chip is generating a sound signal. Thus, the microcontroller can monitor the sound signal output of the sound chip such that it knows when a sound signal is being generated and when it is not.

It should be noted that the microcontroller activates the sound chip and the control circuit independently. Thus, if the sound chip is not operational and the device is simultaneously moved at a magnitude above the threshold level in two directions, the sound chip will generate the sound signal at the second speed, without first generating a sound signal at the first speed.

One commercially available sound chip suitable for use in this application is Part No. aP89010 Voice OTP IC, which is a low voltage CMOS 16-bit bus buffer supplied by Aplus Integrated Circuits Inc. of Taipei, Taiwan.

Figure 2:
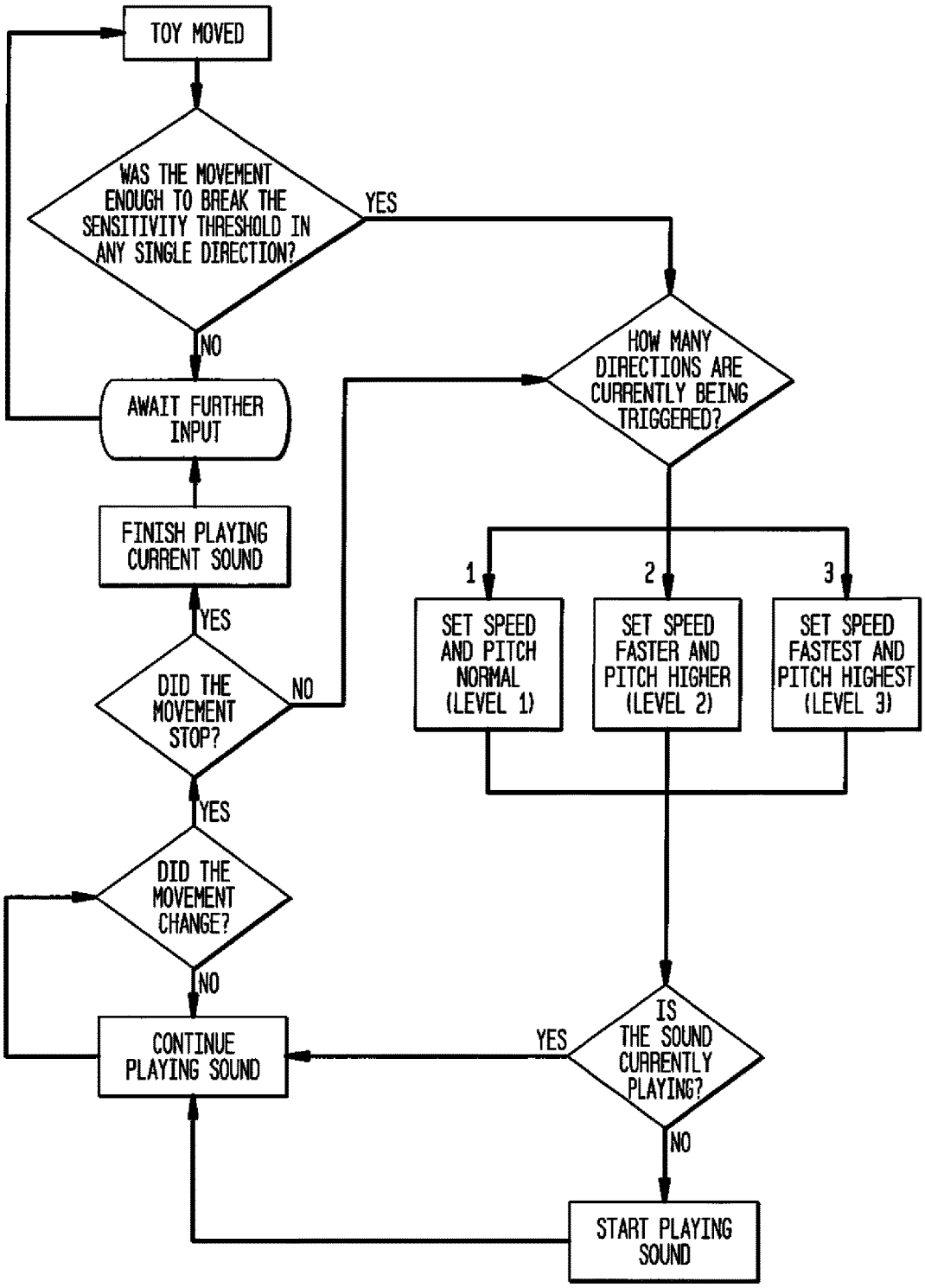
FIG. 2 is a flow chart of the operation of the first preferred embodiment of the present invention.

Reference is now made to FIG. 2 which is a flow chart illustrating the steps in the operation of the device of the present invention. When movement is detected in any direction, a determination is made as to whether the magnitude of the motion in any single direction is above a threshold level, indicating that the movement is of sufficient magnitude to cause the sound chip to generate a sound signal. If it is below the threshold, the device does nothing and awaits further input.

If, on the other hand, motion in any direction is detected to be above the threshold level, a determination is made as to how many different directions are currently above the threshold level (that is, being "triggered"). If only one direction is being triggered, the sound chip generates a sound signal at a first speed level (level 1). If two directions are being triggered, the sound chip generates a sound signal at a second speed level (level 2). If three directions are being triggered, the sound chip generates a sound signal at a third speed level (level 3).

The microcontroller monitors the output of the sound chip to determine if the sound signal is currently being generated. If it is not, the microcontroller will cause the sound chip to start generating the sound signal at the appropriate level. If the sound signal is currently being generated, the sound chip continues generating the sound signal.

The microcontroller then makes a determination as to whether there has been a change in the detected movement. If not, the sound chip continues to generate the sound signal. On the other hand, if movement has stopped, the sound chip will stop generating the sound signal and the device awaits further input indicating new movement.

Figure 3:
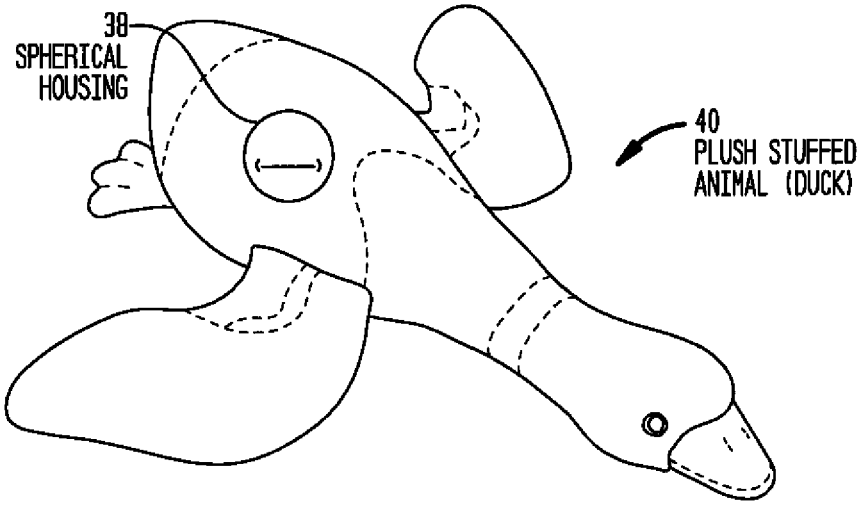
FIG. 3 is a drawing of a typical plush stuffed animal in the form of a duck within which the sound generator of the present invention is situated.

FIG. 3 illustrates a typical toy that the device of the present invention might be used in. The device may be situated in a spherical housing 38 made of plastic or rubber. Housing 38 may be situated in a plush stuffed animal, such as a duck 40. However, neither the particular shape of the housing or the configuration or type of product in which the housing is situated should be considered to be a limitation on the present invention, as the sound generating device of the present invention could be used in a wide variety of different products in which it would be useful to have generated sounds with different characteristics.

It will now be appreciated that the present invention relates to a variable sound generating device suitable for use in a movement-activated product that makes sounds. The sounds are produced as a response to actual movement, rather than from externally applied pressure as in conventional squeeze toys. As the device is thrashed around and its movement changes in direction and/or intensity, the characteristics of the emitted sound also changes. As such, a toy having the present invention can keep the interest of a pet longer than a simple pressure-squeaker mechanism.

The sound generator creates sounds with three different characteristics, depending upon the magnitude and direction of the movement of the device. Sound at the appropriate speed level will be generated once movement of a magnitude above the threshold level is detected and the sound will continue to be generated for a pre-set time period after movement has stopped.

The accelerometer and the sound chip are connected to the microcontroller. A series of three resistors are attached to the oscillator input of the sound chip, which is typically used to set the sound chip clock speed to match the rate at which the sound or sounds were recorded. Two of those resistors are connected with "bypass" MOSFETs to allow for different sound activity.

The microcontroller repeatedly polls the accelerometer to see if the device is being moved. If it is, and the movement is above the sensitivity threshold, the microcontroller causes the sound chip to start generating the sound. While it is doing that, the microcontroller also takes note of how many axes are being moved at a magnitude exceeding the sensitivity threshold.

If one axis is being triggered, then nothing regarding speed of the sound signal needs to be set and the combined resistance of all three resistors sets the processing speed of the sound chip. If two axes are being triggered at the same time, the microcontroller sends a high voltage signal to one logic-level MOSFET that bypasses one of the resistors attached to the oscillator of the sound chip. That causes the sound chip to operate faster, causing the sound chip to generate a pre-recoded sound at a higher speed—it essentially acts as if the pre-recorded sound is supposed to be generated at a faster bitrate. If all three axes are being triggered simultaneously, the microcontroller sends a high voltage signal to both logic-level MOSFETs, causing two of the resistors attached to the oscillator of the sound chip to be bypassed, and the speed of the sound signal to be further increased. The default mode of operation for the MOSFETs is normally off when the microcontroller provides a low voltage signal to the gates of the transistors.

Figure 4:
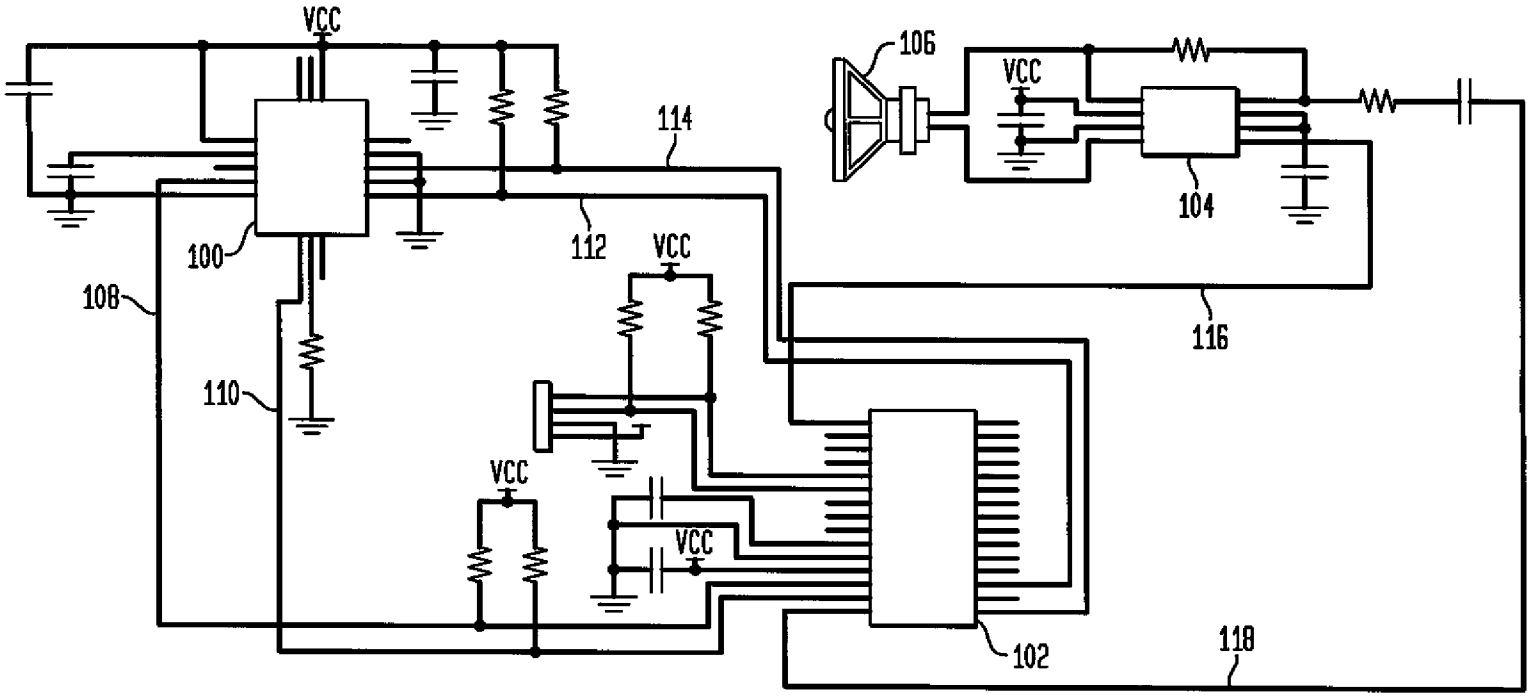
FIG. 4 is a circuit diagram of the components of a second preferred embodiment of the present invention.

FIGS. 4-8 relate to the software based second preferred embodiment of the present invention. FIG. 4 is a block diagram of the components of the second preferred embodiment of the device. This embodiment includes a movement parameter sensor, such as an accelerometer, capable of sensing the direction and/or magnitude (force) of movement in one or more directions. The sensor provides the input to a microprocessor. The microprocessor controls the characteristics (speed and pitch) of a pre-recorded sound, which is played by the device through an amplification circuit and a speaker, in accordance with the sensed motion.

As depicted in FIG. 4, the second preferred embodiment of the device includes: a sensor capable of detecting a parameter of movement, such as the direction and/or magnitude (force) of movement to which the device is subjected, which in this embodiment takes the form of an accelerometer 100. A microcontroller 102 is connected to receive the output of accelerometer 100. An amplification circuit 104 is connected to receive the output from microcontroller 102 and to drive a speaker 106 in accordance with the output of microcontroller 102.

Accelerometer 100 may take the form of an Xtrinsic 3-axis 10-bit Digital capacitive macromachined accelerometer. The accelerometer has flexible user-programmable options which can be configured to generate inertial wake-up interrupt signals and to monitor events. It has three embedded channels which permit free fall or motion detection, pulse detection, and jolt detection. This component has a low power mode and is configurable for auto-wake and sleep (rest) functions. Such an accelerometer is available from Freescale Semiconductor Inc. of 6501 William Cannon Drive West Austin, Tex. 78735.

The SCK output 108 and the SDA output 110 of accelerometer 100 are connected to the data inputs of microcontroller 102. The microcontroller may take the form of Part No. R5F100ACASP which is available from Renesas Electronics America Inc. of 2880 Scott Boulevard, Santa Clara, Calif. 95050. That microcontroller includes a 16 bit CPU with a maximum frequency of 32 MHz. The INTP2 output 112 from the accelerometer is connected to the INTP2 input pin of the microcontroller. The INTP3 output 114 from the accelerometer is connected to the INTP3 input pin of the microcontroller.

The audio standby output 116 of microcontroller 102 is connected to the standby input of amplifier 104. The audio pulse width modulation output 118 of microcontroller 102 is connected to the voltage input of amplified 104.

The amplifier may take the form of Part No. TS487 available from STMicroelectronics of Geneva, Switzerland. It is a dual audio power amplifier capable of driving, in single-ended mode, either a 16 or a 32 W stereo headset. An externally-controlled standby mode reduces the supply current to 10 nA (typ.). The unity gain stable circuit can be configured by external gain-setting resistors or used in a fixed gain version. The output of amplifier circuit 104 can drive a headset or, as shown, an audio speaker 106.

Figure 5:
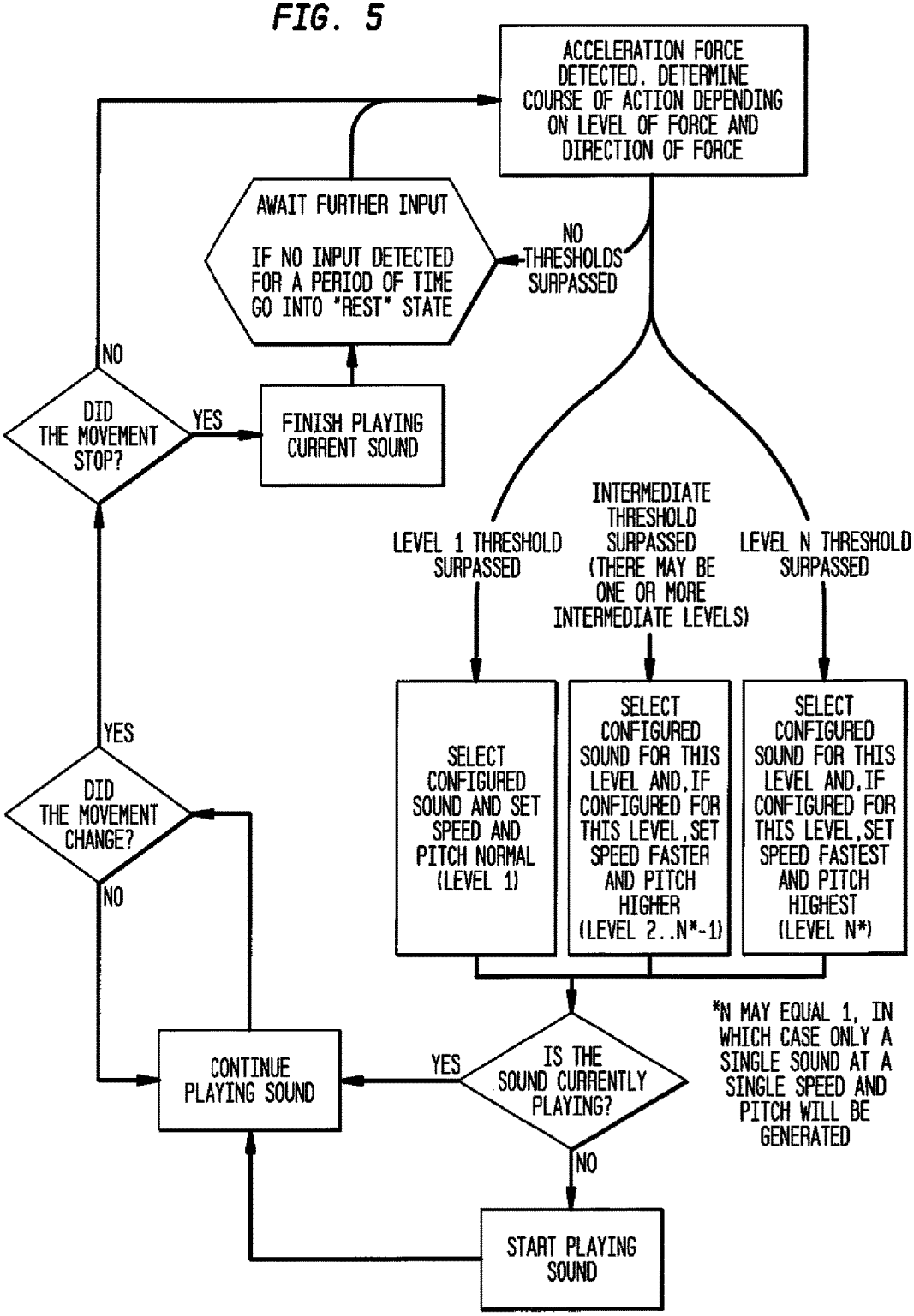
FIG. 5 is a flow chart of the function of the second preferred embodiment of the present invention.

FIG. 5 is a flow chart illustrating the function of the electronic components which create the desired sounds in response to movement of the device. In this second preferred embodiment, the control over the characteristics of the sound generated by the device is software based, in contrast to the first preferred embodiment wherein that function is controlled by hardwired circuits. However, all perceived functionality, in terms of how the user of such a device would interact with the device, are the same in both embodiments.

In the first embodiment, a separate pre-programmed sound playback integrated circuit D ("Sound IC") is controlled by the pre-programmed microcontroller. The microcontroller uses an algorithm to determine when to trigger sound playback and controls a mechanism by which the "speed" (both pitch and frequency) of a pre-recorded "sound" (not tone generation) is determined.

In the second preferred embodiment, as illustrated in FIG. 4, the "Sound IC" functionality, as well as the "speed" control mechanism, is incorporated into the software of microcontroller 102.

As illustrated by the flow chart of FIG. 5, which illustrates the function of the software, when the device is moved (acceleration force is sensed), a determination is made by the microcontroller as to whether the movement sensed exceeds any one of a number of predetermined playback thresholds or whether the device is in free fall. If the aforementioned thresholds are exceeded, or if the device is in free fall, the playback "speed" of the "sound" is determined. Simultaneously, the particular "sound" to be played is selected.

As an example, a particular direction of movement may determine which, of many, pre-recorded sounds to play and the magnitude of movement may determine the speed at which to play the selected sound. Any combination of force magnitudes and/or directions may be configured.

The exemplary device uses three levels of "speed" based on the magnitude of acceleration force being sensed. One method by which the speed may be calculated can be simply to control the speed and pitch of playback sound to be proportional to the amount of acceleration force sensed. More or fewer than three sound levels may be employed; any reference to three speed levels is used for illustrative purposes.

If the "sound" is not currently playing and a "speed" has been set, the "sound" will begin playing at that speed. If the "sound" is already playing, the "speed" will be set on-the-fly (during "sound" playback), changing the "speed" of the "sound" as it continues to play. Additionally, the particular sound being modified can also change so that the "speed" is applied to a different pre-recorded sound.

Any time changes in acceleration force are sensed, the "speed" will be changed accordingly until no threshold-exceeding acceleration forces are sensed (AND the device is not in free fall). This is considered a "rest" state. Upon entering "rest" for a predetermined time period, the sound will stop.

Assuming the device starts in the "rest" state, when acceleration is detected by the accelerometer, a determination is made as to the course of action depending upon the level of forced sensed. If the device is in free fall or a threshold is surpassed, the speed and pitch of the generated sound is set at a corresponding level and a particular sound is selected for playback. As different combinations of force magnitude and/or direction thresholds are surpassed, the speed of the generated sound is set faster or slower and the pitch of the generated sound is set higher or lower depending upon the configuration.

Once the level of the generated sound is set, the microcontroller determines if the sound is already being generated. If it is not, the microcontroller causes the sound generating circuit to start playing the selected sound at the speed and sound level previously determined. If the sound generator is already playing, the microcontroller causes the sound generating circuit to continue the play the sound until a change in the movement is sensed. If the movement has stopped, the sound generating circuit will finish playing the current sound and, if no movement exceeding any of the playback thresholds is detected for a pre-set period of time, the microcontroller will enter the "rest" or "sleep" state. On the other hand, if movement above one of the playback thresholds has not stopped, the software will cycle back to the beginning, evaluate the force detected and determine the appropriate sound and the level of that sound to be generated.

Figure 6:
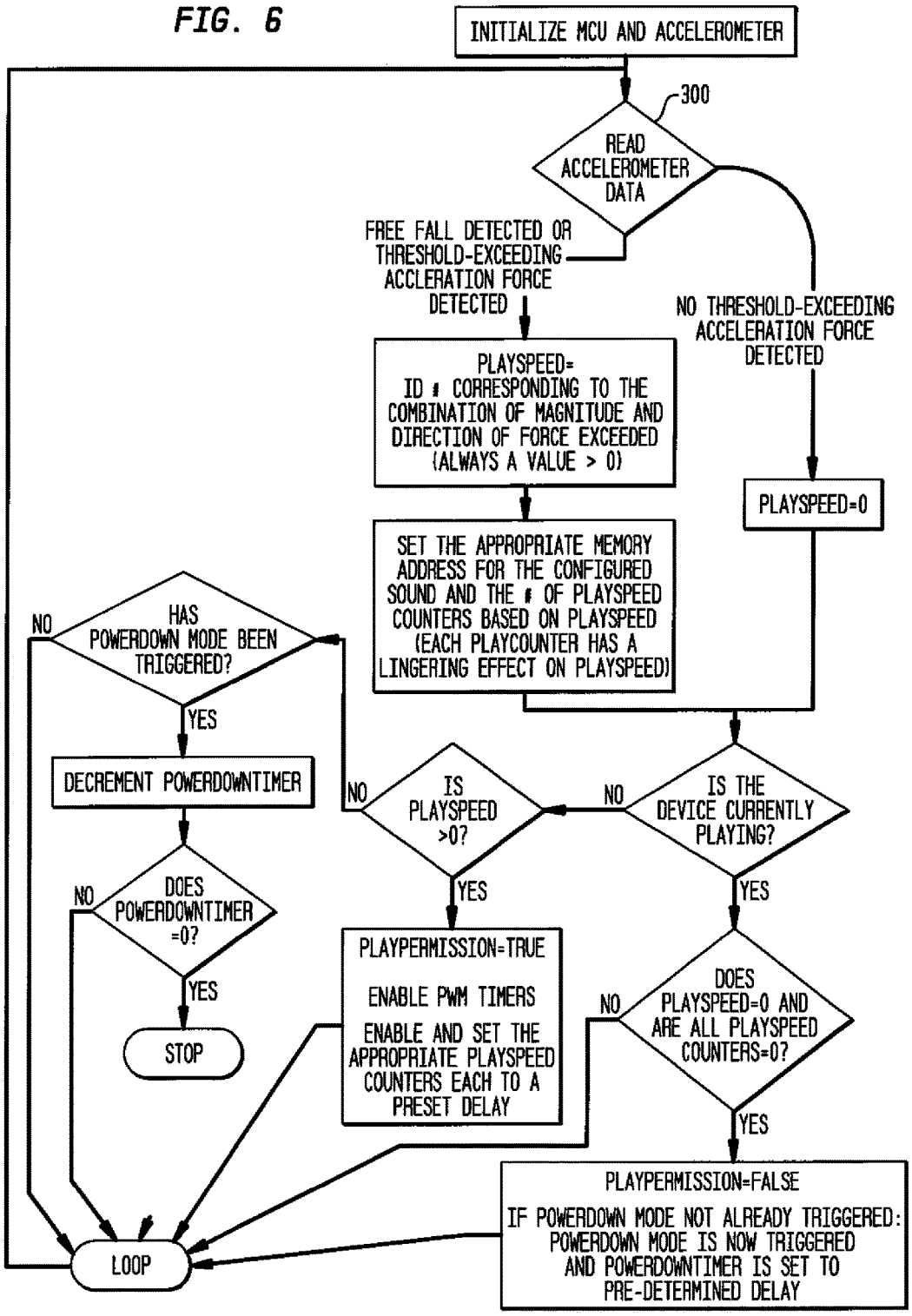
FIG. 6 is a high level flow chart of the software of the second preferred embodiment of the present invention.
Figure 7:
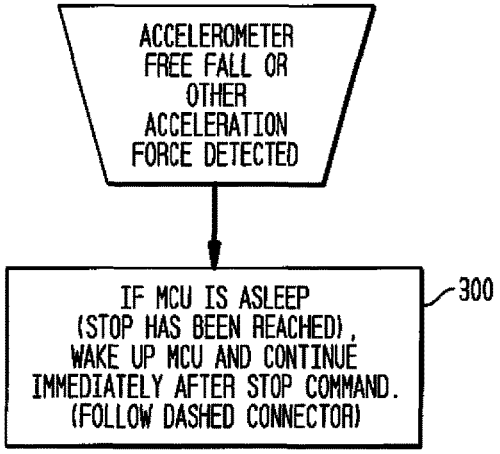
FIG. 7 is a flow chart of the software relating to the external interrupts of the second preferred embodiment of the present invention.
Figure 8:
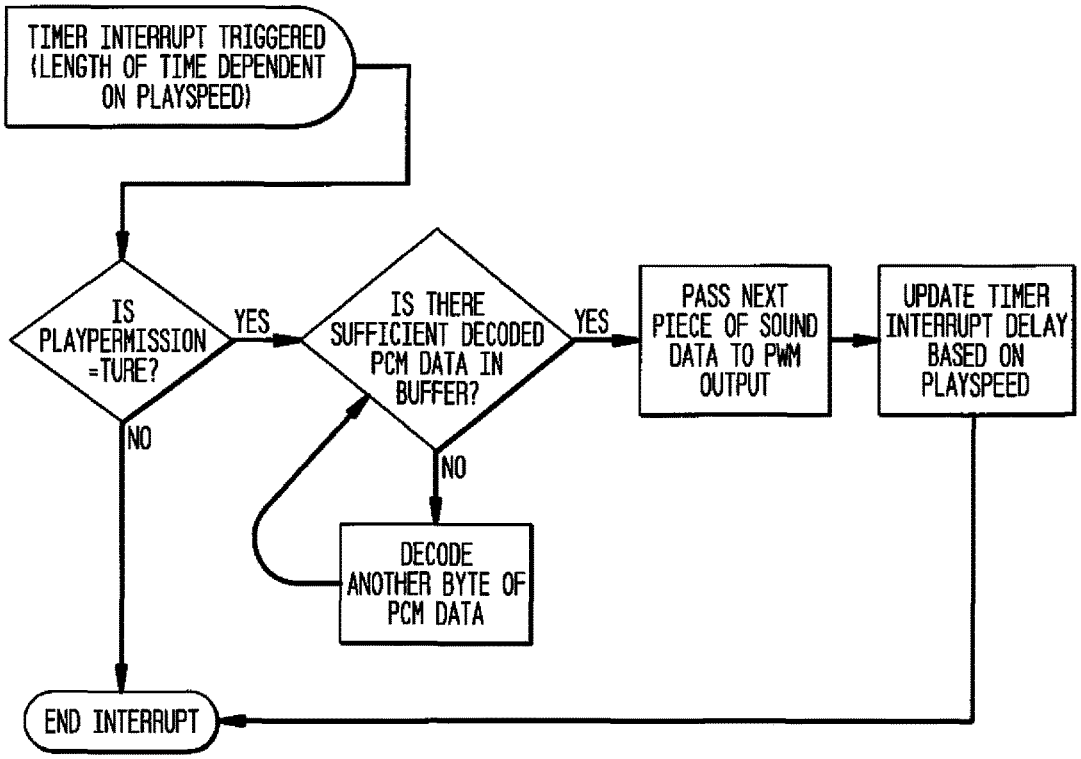
FIG. 8 is a flow chart of the software relating to the internal interrupts of the second preferred embodiment of the present invention.

FIGS. 6-8 are flowcharts illustration the software procedure. Three separate portions of the software are illustrated. The primary logic portion of the software is illustrated in FIG. 6. FIG. 7 shows the portion of the software which relates to external interrupts sent from the accelerometer under certain conditions. FIG. 8 shows the portion of the software which relates to internal interrupts based on time intervals used for "sound" playback.

As seen in FIG. 6, upon receiving power, the accelerometer 100 and the microcontroller 102 are initialized. A read command is sent to the accelerometer to assess the current levels of acceleration forces being sensed along all three axes.

There are two paths to follow at this point, depending on the acceleration force sensed. If the device is detected to be in free fall, the PlaySpeed is set accordingly and Axis Counters are set accordingly (or disabled as the configuration may be). Additionally, the sound is also selected according to the configuration at this stage.

If the PlaySpeed Counters are enabled for the sensed threshold-level, those counters are set to a pre-determined number of cycles. The PlaySpeed Counters allow the forces sensed to have an impact on the "speed" of the "sound" after the force is no longer sensed to produce a smoother effect on the changing "speeds". If no threshold-exceeding forces detected, the PlaySpeed is set to 0. Next, the microcontroller determines whether the sound generator is currently playing the pre-recorded "sound" and follows a course of action depending on several states.

If the device is playing sound, AND the PlaySpeed is 0, AND all PlaySpeed Counters are equal to 0, the device revokes the permission to continue playing the sound (PlayPermission=False). The device is programmed to finish playing the current "sound" and will not begin playing it again unless PlayPermission is given (PlayPermission=True). The device then enters a PowerDown mode and sets a PowerDown Timer to a pre-determined number of cycles. After that, the program loops back and reads the accelerometer output again.

If the device is playing sound, AND either the PlaySpeed is NOT 0, OR there is at least one PlaySpeed Counter that is greater than 0, all PlaySpeed Counters are decremented by 1 cycle and the program loops back to read the accelerometer output again.

If the device is NOT playing sound, AND the PlaySpeed is greater than 0, permission to play the sound is granted (PlayPermission=True), the PWM timers (software interrupt timers) are enabled and set appropriately using PlaySpeed, and the PlaySpeed Counters corresponding to the force sensed are set to a pre-determined number of cycles, and the corresponding sound is selected for playback. The program then loops back to check the accelerometer output.

If the device is NOT playing sound, AND the PlaySpeed is equal to 0, then if the device has entered PowerDown mode, the PowerDown Timer is decremented. If at this point, the PowerDown Timer is equal to 0, the device enters a "rest" state ("STOP"). Upon awakening from sleep (as a result of an external interrupt), the program will continue from the read the accelerometer step. If the PowerDown Timer is still greater than 0 at this point, the program loops back to read the accelerometer output step.

FIG. 7 illustrates the external interrupts portion of the software. External interrupts are currently set up to listen for force detection or awake/sleep mode changes from the accelerometer. However, this is a function of the specific technology and the specific devices being used in this exemplary embodiment to facilitate power-conservation techniques.

FIG. 8 illustrates the internal interrupts portion of the software. There are two internal interrupts that are used to actually output the sound and control the other aspects of sound encoding/decoding. The "speed" control internal interrupts are illustrated in this figure. Upon the interrupt being thrown, the software determines whether it has permission to play the "sound". If permission has NOT been granted (PlayPermission=False), the interrupt is terminated.

If permission has been granted (PlayPermission=True), the software determines whether there is sufficient "sound" data decoded for output. If there is NOT enough data in the buffer, the software decodes enough of the data to prevent a buffer under-run. Once enough "sound" data is decoded in the buffer, the next piece of "sound" data is passed to PWM output and the sound is produced at the speaker. The interrupt timer is then updated based on the current PlaySpeed setting and the interrupt is terminated.

It will now be appreciated that the present invention can be implemented with hardwired sound generating and frequency control components, such as in the first preferred embodiment disclosed herein, or in a software version such as in the second preferred embodiment disclosed herein. In either version, a movement parameter sensing component such as an accelerometer is used to monitor device movement and a microcontroller is used to regulate the speed and pitch of a pre-recorded sound which is played in response to device movement exceeding a pre-determined threshold. Also, in either version, the characteristics of the sound emitted may be changed on the fly providing those sounds exist in memory.

The device of either preferred embodiment of the invention is well suited for use in a toy, such as a pet toy. However, the device may have many other applications, and the invention should not be considered to be limited to such use.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A process executing on a three axis acceleration sensitive sound producing apparatus, comprising a three axis accelerometer and a microcontroller, the microcontroller comprising at least one stored sound, an interrupt timer and a pulse width modulation timer, the process executed by motion of the apparatus sensed by the three axis accelerometer, comprising the steps of:

(a) sensing, by said three axis accelerometer, said motion of said apparatus;

(b) measuring, by said three axis accelerometer, acceleration associated with said sensed motion in each direction of three directions;

(c) generating, by said three axis accelerometer, accelerometer output signals, comprising acceleration information and direction information associated with said measured sensed motion in said each direction of said three directions;

(d) communicating, by said three axis accelerometer, said generated accelerometer output signals to said microcontroller;

(e) receiving and processing, by said microcontroller, said communicated accelerometer output signals into an interrupt timer input signal, according to how many said accelerometer output signals exceed a predetermined threshold;

(f) modulating, by said interrupt timer, said pulse width modulation timer according to said interrupt timer input signal, generating, by said pulse width modulation timer, a pulse width timer modulation output signal;

(g) regulating, by said pulse width modulation timer, playback speed of said at least one stored sound according to said pulse width timer modulation output signal, comprising:

varying said playback speed, by said pulse width modulation timer, according to how many said accelerometer output signals exceed said predetermined threshold, comprising:

increasing, by said pulse width modulation timer, said playback speed when the number of said accelerometer output signals exceeds said predetermined threshold increases and decreasing, by said pulse width modulation timer, said playback speed when said number of said accelerometer output signals exceeds said predetermined threshold decreases; wherein said regulating results in a regulated playback speed;

(h) playing back, by said microcontroller, said at least one stored sound according to said regulated playback speed.

* * * * *